US006374809B2

(12) United States Patent
Satou

(10) Patent No.: US 6,374,809 B2
(45) Date of Patent: Apr. 23, 2002

(54) STRUCTURE OF MOUNTING FUEL INJECTION VALVE TO FUEL DISTRIBUTION PIPE

(75) Inventor: Kenichi Satou, Kakuda (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 09/741,903

(22) Filed: Dec. 22, 2000

(30) Foreign Application Priority Data

Dec. 29, 1999 (JP) ..... 11-377392

(51) Int. Cl.[7] ..... F02M 55/02
(52) U.S. Cl. ..... 123/470; 123/468
(58) Field of Search ..... 123/468, 469, 123/470

(56) References Cited

U.S. PATENT DOCUMENTS 5,520,151 A * 5/1996 Gras et al. ..... 123/470
5,803,052 A * 9/1998 Lorraine et al. ..... 123/470
6,019,089 A * 2/2000 Taylor et al. ..... 123/470
6,053,149 A * 4/2000 Lorraine ..... 123/470
6,283,772 B1 * 9/2001 Braun et al. ..... 439/100

* cited by examiner

*Primary Examiner*—Tony M. Argenbright
*Assistant Examiner*—Hai Huynh
(74) *Attorney, Agent, or Firm*—Arent Fox Kintner Plotkin & Kahn, PLLC

(57) ABSTRACT

In a structure of mounting a fuel injection valve, an annular connecting groove 12 is defined in an outer peripheral surface of an intermediate portion of a fuel injection valve I which has a fuel inlet portion 6 inserted in a fuel supply port 16 in a fuel distribution pipe D, and a connecting flange 17 is formed in the fuel supply port 16 and aligned axially with the connecting groove 12. A collar portion 22 and a locking groove 21 are engaged with the connecting groove 12 and the connecting flange 17, respectively, and are provided in a connecting member 20 for resiliently clamping the fuel injection valve I and the fuel supply port 16 from opposite outsides. A positioning bore 18 is provided in the connecting flange 17, and a positioning projection 13 is formed on the fuel injection valve I to be brought into engagement in the positioning bore 18 simultaneously with the insertion of the fuel inlet portion 6 into the fuel supply port 16. Thus, it is possible to easily connect the fuel injection valve to the fuel distribution pipe, while enhancing the accuracy of positioning of the fuel injection valve in a rotating direction on the fuel distribution pipe.

5 Claims, 5 Drawing Sheets

STRUCTURE OF MOUNTING FUEL INJECTION VALVE TO FUEL DISTRIBUTION PIPE

BACKGROUND OF THE INVENTION

1. Field of the Invention

The present invention relates to a structure of mounting a fuel injection valve to a fuel distribution pipe, in which an annular connecting groove is defined in an outer peripheral surface of an intermediate portion of a fuel injection valve which has, at one end thereof, a fuel injection portion inserted in a fuel injection bore in an engine and at the other end thereof, a fuel inlet portion inserted in a fuel supply port in a fuel distribution pipe; a connecting flange is formed in the fuel supply port and aligned axially with the connecting groove; a collar portion and a locking groove are engaged with the connecting groove and the connecting flange, respectively, and are provided in a connecting member for resiliently clamping the fuel injection valve and the fuel supply port from opposite outsides.

2. Description of the Related Art

Such structure of mounting the fuel injection valve to the fuel distribution pipe is conventionally known, as disclosed in Japanese Patent No.2,837,268, for example. In such structure, a pair of positioning recesses in the connecting member are engaged with positioning projections formed on outer surfaces of the fuel distribution pipe and the fuel injection valve, respectively in order to position the fuel injection valve in a rotating direction on the fuel distribution pipe.

In a structure in which the positioning of the fuel injection valve in the rotating direction on the fuel distribution pipe is carried out through the connecting member, as described above, positioning engage portions are required at two places between the fuel distribution pipe and the connecting member and between connecting member and the fuel injection valve. For this reason, backlashes (clearances) in the engage portions inevitable in the manufacture are accumulated, resulting in a degraded accuracy of positioning of the fuel injection valve. Thus, when the fuel injection valve has been mounted in an engine, a deviation is liable to be produced in the direction of injection of fuel from the fuel injection valve. When the fuel distribution pipe and the fuel injection valve are connected to each other by a single connecting member, the following disadvantage is encountered: The engagements must be carried out simultaneously at four places (1) between portions of the connecting member and the fuel distribution pipe for axially connecting them, (2) between portions of the connecting member and the fuel injection valve for axially connecting them, (3) between portions of the connecting member and the fuel distribution pipe for positioning them in the rotating direction, and (4) between portions of the connecting member and the fuel injection valve for positioning them in the rotating direction. In this case, a deal of skill is required for such assembling operation, and the assemblability is remarkably poor.

SUMMARY OF THE INVENTION

The present invention has been accomplished in view of such circumstances, and it is an object of the present invention to provide a structure of mounting a fuel injection valve to a fuel distribution pipe, wherein the fuel injection valve can be easily connected to the fuel distribution pipe, while enhancing the accuracy of positioning of the fuel injection valve in a rotating direction on the fuel distribution pipe.

To achieve the above object, according to a first aspect and feature of the present invention, there is provided a structure of mounting a fuel injection valve to a fuel distribution pipe, in which an annular connecting groove is defined in an outer peripheral surface of an intermediate portion of a fuel injection valve which has, at one end thereof, a fuel injection portion inserted in a fuel injection bore in an engine and at the other end thereof, a fuel inlet portion inserted in a fuel supply port in a fuel distribution pipe; a connecting flange is formed in the fuel supply port and aligned axially with the connecting groove; a collar portion and a locking groove are engaged with the connecting groove and the connecting flange, respectively, and are provided in a connecting member for resiliently clamping the fuel injection valve and the fuel supply port from opposite outsides, wherein a positioning bore is provided in the connecting flange, and a positioning projection is formed on the fuel injection valve so as to be brought into engagement in the positioning bore simultaneously with the insertion of the fuel inlet portion into the fuel supply port.

With the first feature, the positioning of the fuel injection valve in the rotating direction on the fuel distribution pipe is carried out only by the engagement of the positioning projection of the fuel injection valve in the positioning bore in the fuel distribution pipe at one place. Therefore, there is no accumulation of backlashes in engage portions and hence, it is possible to enhance the accuracy of positioning of the fuel injection valve in the rotating direction. Moreover, the axial connection of the fuel distribution pipe and the fuel injection valve by the connecting member is necessarily conducted after the positioning of the fuel injection valve in the rotating direction. Therefore, the positioning operation and the connecting operation can be carried out sequentially and extremely easily, leading to an extremely good assemblability.

According to a second aspect and feature of the present invention, in addition to the first feature, at least one of the positioning projection and the positioning bore is formed to be convergent toward the fuel inlet portion.

With the second feature, the engagement of the positioning projection and the positioning bore with each other can be conducted easily, and after such engagement, the backlash between both of the positioning projection and the positioning bore can be reduced to further enhance the accuracy of positioning of the fuel injection valve in the rotating direction.

According to a third aspect and feature of the present invention, in addition to the first or second feature, the connecting groove and the positioning projection are formed integrally in an outer skin formed from a synthetic resin by molding to cover an outer periphery of a coil of the fuel injection valve.

With the third feature, the connecting groove and the positioning projection can be formed along with the outer skin made of the synthetic resin on the fuel injection valve, and a post-processing is not required, which can contribute to a reduction in cost.

According to a fourth aspect and feature of the present invention, in addition to any of the first to third features, the positioning projection is provided with a step for abutting against the connecting flange to define a depth of insertion of the fuel injection valve into the fuel supply port.

With the fourth feature, when the depth of insertion of the fuel injection valve into the fuel supply port is defined by the abutment of the step of the positioning projection on the fuel injection valve against the connecting flange of the fuel distribution pipe, a distance between the connecting groove in the fuel injection valve and the connecting flange of the fuel distribution pipe is constant. Thus, the collar portion and the locking groove of the connecting member can be brought precisely into engagement with the connecting groove and the connecting flange, respectively, leading to a further improved assemblability, and an automatic assembling using a robot is feasible.

According to a fifth aspect and feature of the present invention, in addition to any of the first to fourth features, the positioning projection is formed so as to be connected to a bottom of the connecting groove.

With the fifth feature, the root of the positioning projection is thickened and increased in strength, whereby the strength of a portion of the injection valve around the connecting groove can be also increased.

The above and other objects, features and advantages of the invention will become apparent from the following description of the preferred embodiment taken in conjunction with the accompanying drawings.

DESCRIPTION OF THE PREFERRED EMBODIMENT

Figure 1:
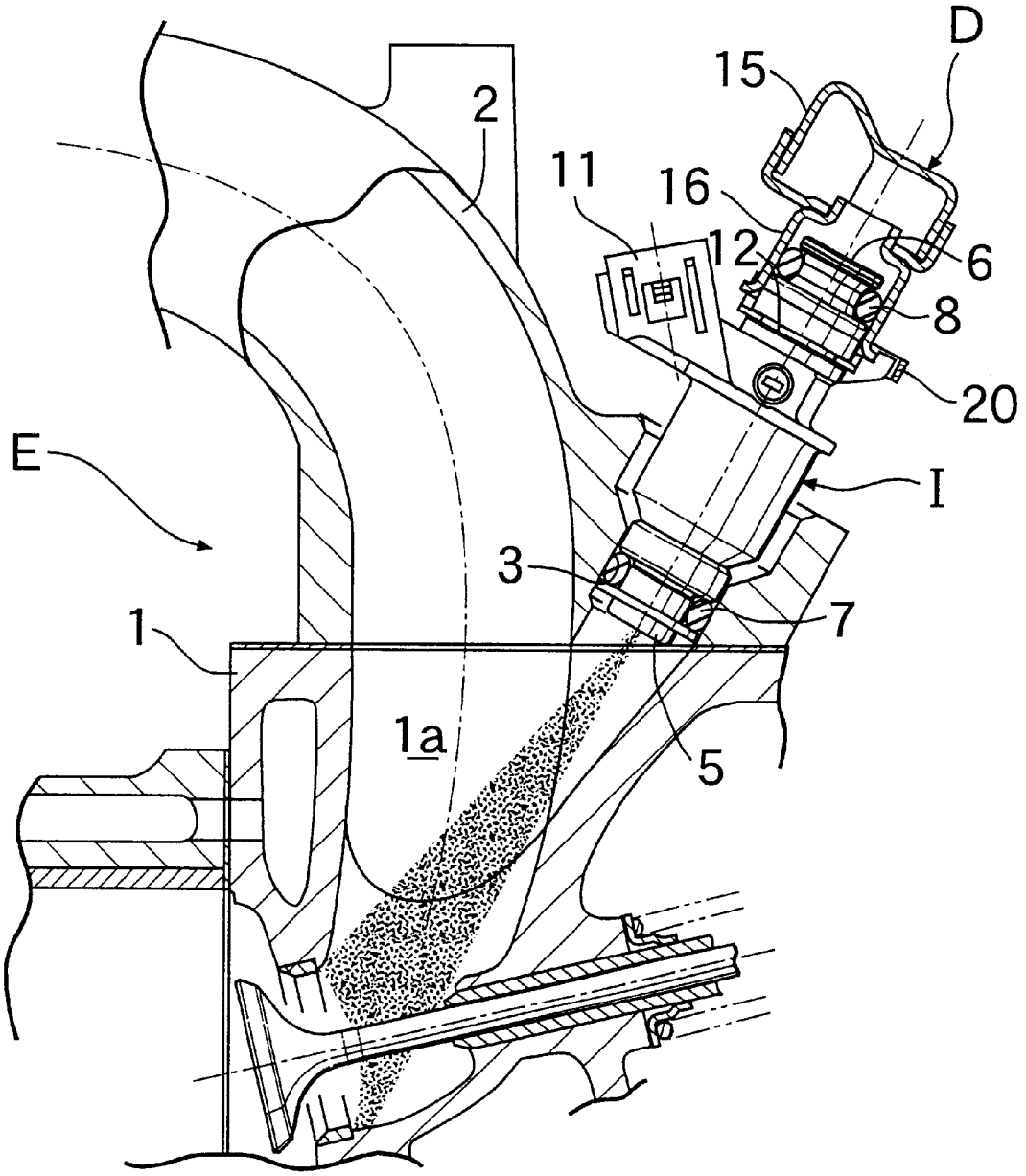
FIG. 1 is a vertical sectional view of an essential portion of a fuel injection-type engine, to which an embodiment according to the present invention is applied.
Figure 2:
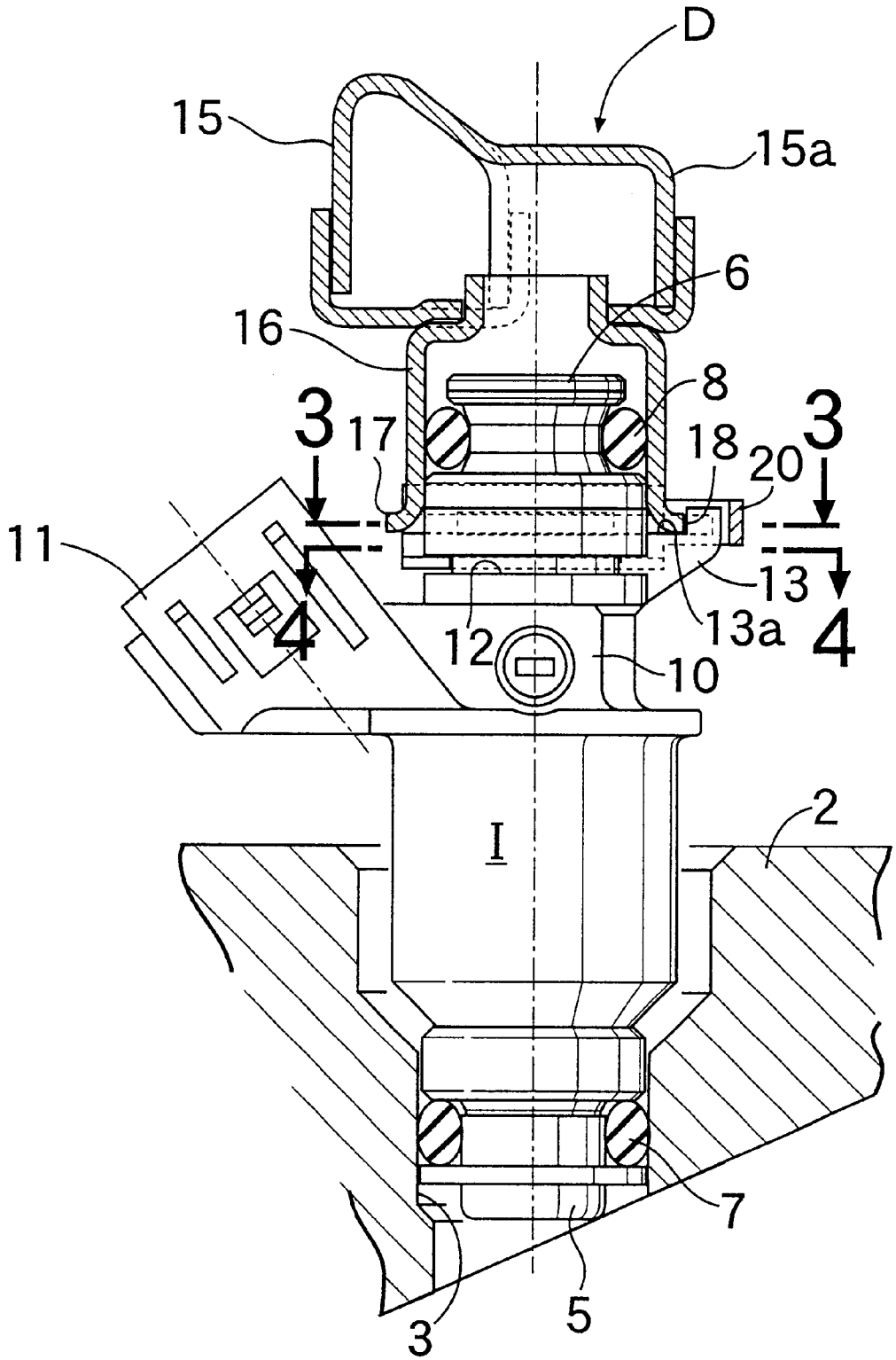
FIG. 2 is an enlarged view of a fuel injection valve shown in FIG. 1 and a portion around the valve.
Figure 3:
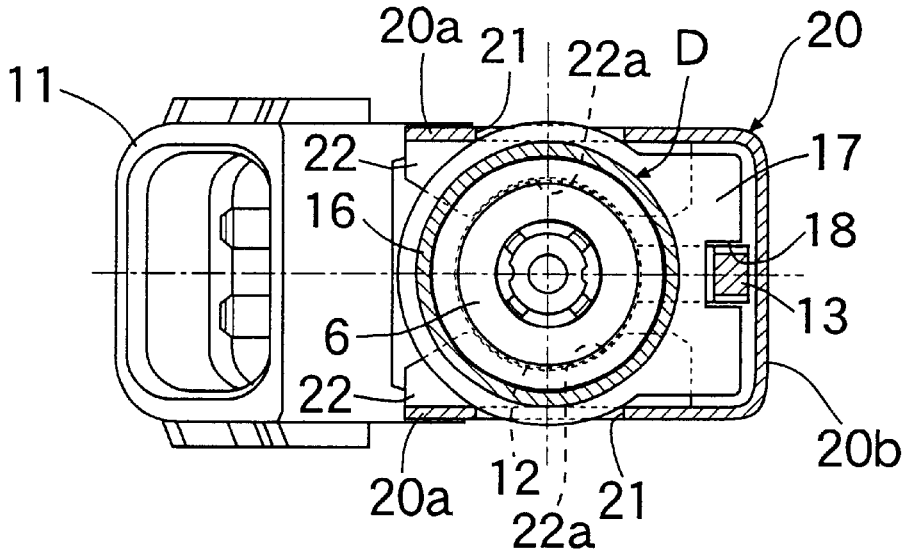
FIG. 3 is a sectional view taken along a line 3—3 in FIG. 2.
Figure 4:
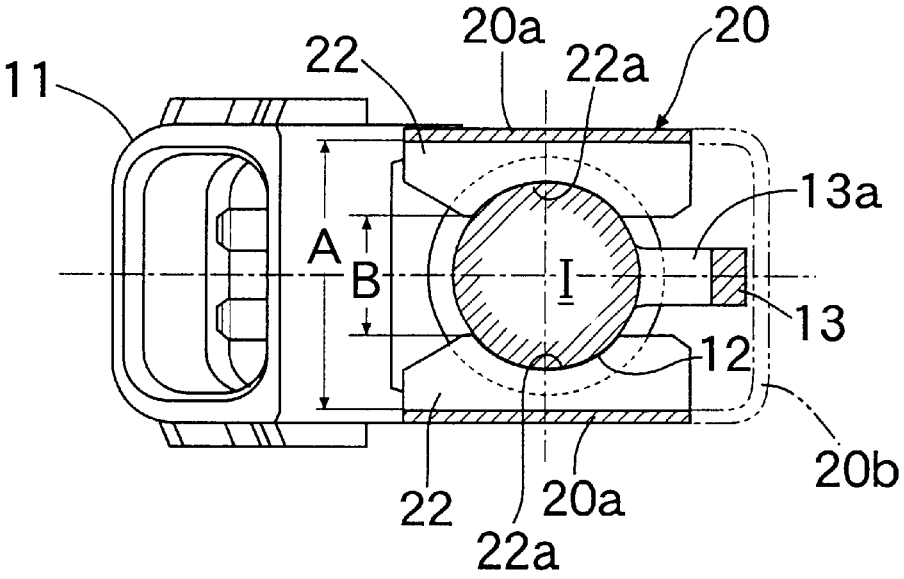
FIG. 4 is a sectional view taken along a line 4—4 in FIG. 2.
Figure 5:
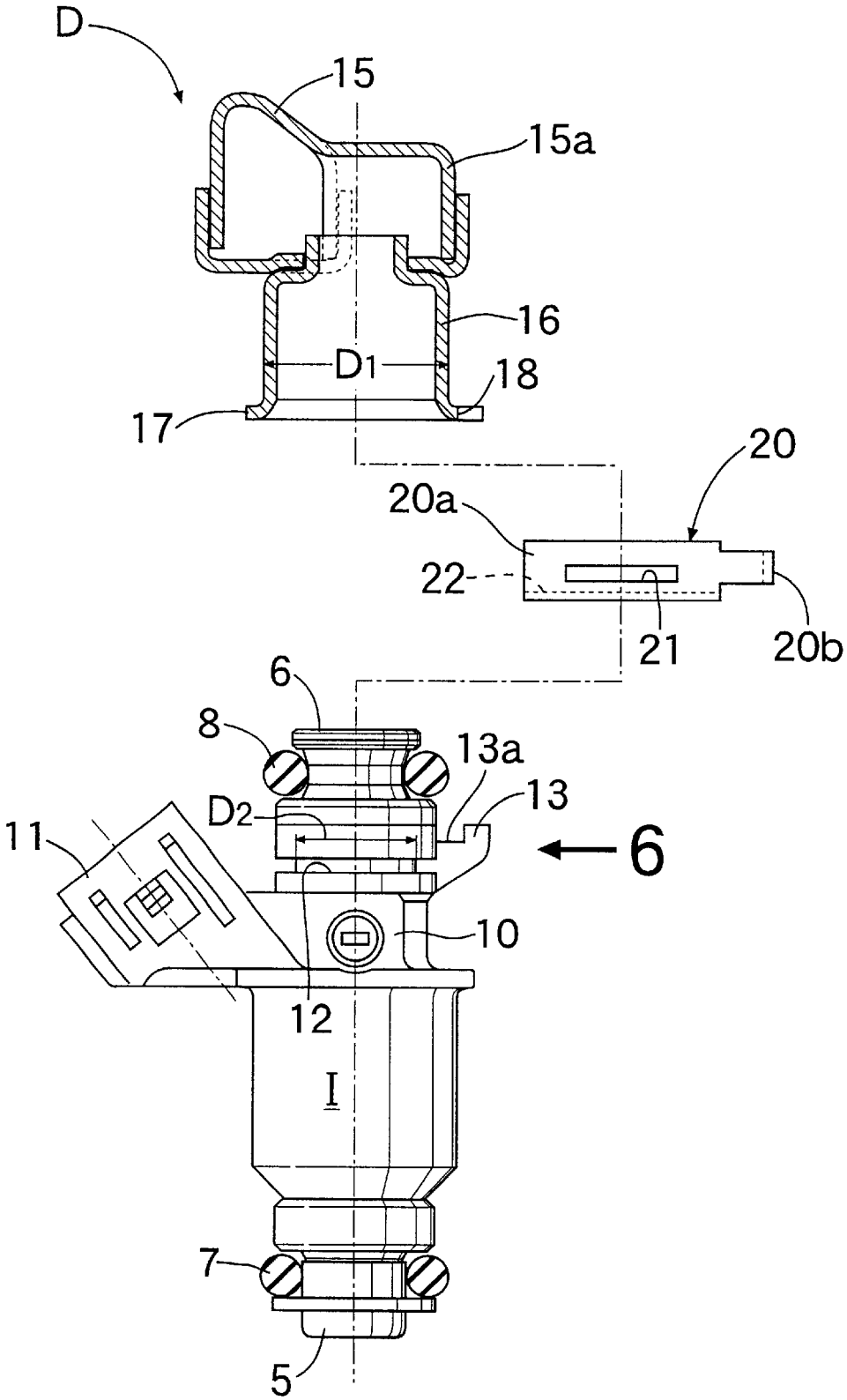
FIG. 5 is an exploded view corresponding to FIG. 2.
Figure 6:
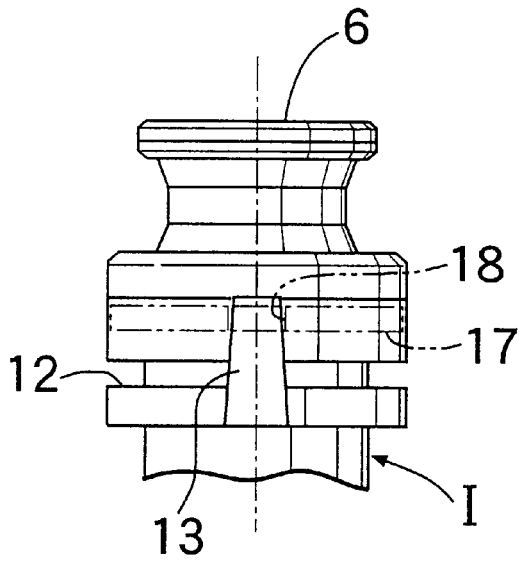
FIG. 6 is an enlarged view taken in the direction of an arrow 6 in FIG. 5.
Figure 7:
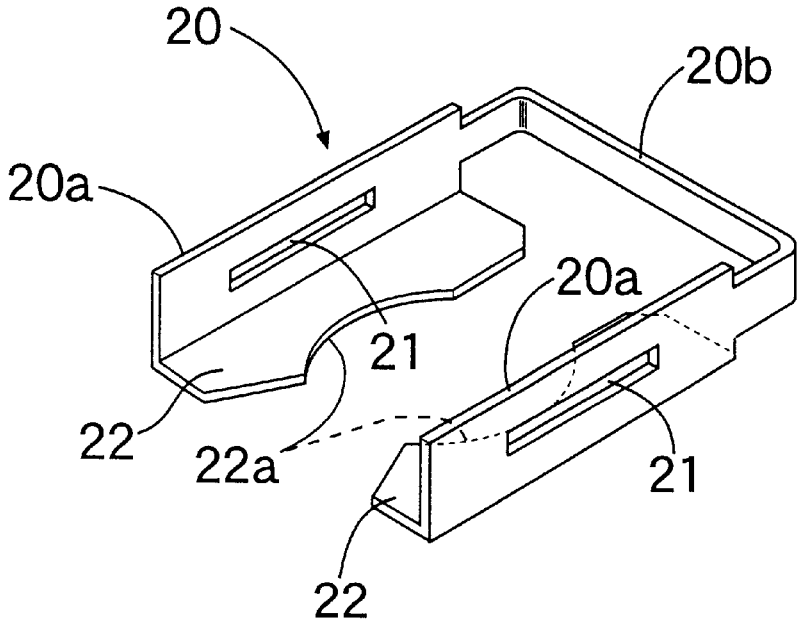
FIG. 7 is a perspective view of a connecting member.

Referring first to FIG. 1, a fuel injection bore 3 is provided in an intake manifold 2 coupled to a cylinder head 1 of an engine E, and a fuel injection portion 5 at a lower end of an electromagnetic fuel injection valve I is fitted into the fuel injection bore 3 with a seal member 7 interposed therebetween. A fuel inlet portion 6 at an upper end of the fuel injection valve I is inserted into a fuel supply port 16 in a fuel distribution pipe D with a seal member 8 interposed therebetween. The fuel distribution pipe D is fixed at a predetermined location on the intake manifold 2 by a securing means which is not shown.

A plurality of fuel injection bores are provided to open into an end surface of the fuel injection portion 5 and inject fuel in a plurality of directions toward that downstream end of an intake port 1*a* in the cylinder head 1, which is branched into a plurality of portions.

The fuel injection valve I is mounted to the fuel distribution pipe D, and the structure of mounting of the fuel injection valve I will be described below with reference to FIGS. 2 to 7.

As shown in FIGS. 2 to 5, an axially intermediate portion of the fuel injection valve I is covered with an outer skin 10 formed by molding from a synthetic resin to coat a coil mounted within the axially intermediate portion, and a coupler body 11, a connecting groove 12 and positioning projection 13 are integrally formed on the outer skin 10. The connecting groove 12 is formed into an annular shape to surround an outer peripheral surface of the outer skin 10, and the positioning projection 13 is formed to extend in an axial direction of the fuel injection valve I across the connecting groove 12 on an opposite side of an axis of the fuel injection valve I from the coupler body 11. In the illustrated embodiment, the positioning projection 13 traverses the connecting groove 12 and then protrudes toward the fuel inlet portion 6, and moreover, is formed to be convergent toward the fuel inlet portion 6 (see FIG. 6).

A step 13*a* abutting against a lower surface of a connecting flange 17 is engaged with the positioning projection 13, so that the depth of insertion of the fuel inlet portion 6 into the fuel supply port 16 is limited by such engagement. A distance between the connecting flange 17 and the connecting groove 12 at that time is set to be equal to a distance between a locking groove 21 and a collar portion 22 of a connecting member 20 which will be described hereinafter.

On the other hand, the fuel distribution pipe D is made by pressing from a steel plate and comprises a fuel passage portion 15 and the fuel supply port 16 coupled to a fuel dispensing portion 15*a* protruding on one side of the fuel passage portion 15. The fuel inlet portion 6 opens at its lower end, and the fuel inlet portion 6 of the fuel injection valve I is fitted into the fuel inlet portion 6 with the seal member 8 interposed therebetween as described above. The connecting flange 17 is integrally formed at the lower end of the fuel supply port 16, and a notch-shaped positioning bore 18 is provided at a predetermined outer peripheral location in the connecting flange 17.

When the fuel inlet portion 6 has been fitted into the fuel supply port 16, the positioning projection 13 of the fuel injection valve I is engaged into the positioning bore 18 in the connecting flange 17, whereby a position of the fuel injection valve I in a rotating direction on the fuel distribution pipe D is defined. The fuel distribution pipe D is fixed at a predetermined location on the intake manifold 2, which results in the definition of a position of the fuel injection valve I in a rotating direction on the intake manifold 2. Thus, the fuel can be injected in the plurality of defined directions from the plurality of fuel injection bores in the fuel injection portion 5.

The fuel injection valve I is also axially connected to the fuel supply port 16 by a connecting member 20 by utilization of the connecting groove 12. The connecting member 20 is made of a steel plate or a synthetic resin and formed into an angular U-shape and comprised of a pair of opposed side plate portions 20*a*, 20*a*, and a connecting plate portion 20*b* integrally connecting ends of the side plate portions 20*a*, 20*a* to each other. The connecting member 20 has entirely moderate resilience. The side plate portions 20*a*, 20*a* have locking grooves 21, 21 provided therein, respectively, so that the connecting flange 17 is engaged in the locking grooves 21, 21, and collar portions 22, 22 are formed on the side plate portions 20*a*, 20*a* to be bent inwards from one side edges of the side plate portions 20*a*, 20*a*, respectively. A distance A between both of the side plate portions 20*a*, 20*a* is set to be equal to or slightly smaller than an outside diameter D1 of the fuel supply port 16. A distance B between both of the collar portions 22, 22 is set to be sufficiently smaller than a diameter D2 of a bottom of the connecting groove 12, and arcuate locking recesses 22*a*, 22*a* are provided at central portions of the collar portions 22, 22, respectively, and the bottom of the connecting groove 12 can be engaged into the locking recesses 22*a*, 22*a*.

The operation of the embodiment will be described below.

To mount the fuel injection valve I to the fuel distribution pipe D, the fuel inlet portion 6 of the fuel injection valve I is first inserted into the fuel supply port 16. Then, the positioning projection 13 of the fuel injection valve I is brought into engagement in the positioning bore 18 in the connecting flange 17, and at the same time, the step 13*a* of the positioning projection 13 is put into abutment against the lower surface of the connecting flange 17. Thus, the distance between the connecting flange 17 and the connecting groove 12 is equal to the distance between the locking groove 21 and the collar portion 22 of the connecting member 20. When the connecting member 20 is then pushed over the fuel injection valve I and the fuel supply port 16 from sideways of the positioning projection 13, the side plate portions 20*a*, 20*a* of the connecting member 20 are once pushed open by the fuel injection valve I and the fuel supply port 16. Thus, when the connecting groove 12 in the fuel injection valve I reaches a position of engagement with the collar portions 22, 22 of the side plate portions 20*a*, 20*a*, and the connecting flange 17 of the fuel supply port 16 reaches a position of engagement in the locking grooves 21, 21 in the side plate portions 20*a*, 20*a*, the locking grooves 21, 21 is brought into engagement with opposite sides of the connecting flange 17, and at the same time, the collar portions 22, 22 are brought into engagement with the connecting groove 12, and the locking recesses 22*a*, 22*a* in the collar portions 22, 22 are brought into engagement with the bottom of the connecting groove 12, with the outer peripheral surface of the fuel supply port 16 remaining clamped by the side plate portions 20*a*, 20*a* of the connecting member 20.

In this manner, the fuel injection valve I is connected to the fuel supply port 16 through the connecting member 20, and the connecting member 20 is maintained at the connected position by the engagement of the locking grooves 21, 21 with the connecting flange 17 and by the engagement of the locking recesses 22*a*, 22*a* in the collar portions 22, 22 with the bottom of the connecting groove 12, and thus, cannot be fallen off indiscriminately by a vibration or the like.

As described above, the positioning of the fuel injection valve I in the rotating direction on the fuel distribution pipe D is conducted only by the engagement of the positioning projection 13 of the fuel injection valve I and the positioning bore 18 in the fuel distribution pipe D with each other at one place. Therefore, there is no accumulation of backlashes of the positioning engagement, and the accuracy of the positioning of the fuel injection valve I in the rotating direction can be enhanced.

Moreover, the axial connection of the fuel distribution pipe D and the fuel injection valve I with each other by the connecting member 20 is necessarily conducted after positioning of the fuel injection valve I in the rotating direction. Therefore, the positioning operation and the connecting operation can be carried out sequentially and extremely easily, leading to an extremely good assemblability.

In this case, the depth of insertion of the fuel injection valve I into the fuel supply port 16 is defined by the abutment of the connecting flange 17 against the step 13*a* of the positioning projection 13 to ensure that the distance between the connecting flange 17 and the connecting groove 12 and the distance between the locking groove 21 and the collar portion 22 of the connecting member 20 are equal to each other. Therefore, the alignment of the connecting flange 17 and the locking groove 21 with each other and the alignment of the connecting groove 12 and the collar portion 22 with each other are conducted automatically and hence, even when a robot is used, the connection of the fuel distribution pipe D and the fuel injection valve I with each other by the connecting member 20 can be carried out easily and precisely.

The positioning projection 13 is formed to be convergent toward the fuel inlet portion 6 and hence, when the fuel injection valve I is inserted into the fuel supply port 16, the engagement of the positioning projection 13 and the positioning bore 18 with each other can be conducted easily. After the engagement, the backlash between the positioning projection 13 and the positioning bore 18 can be reduced to further enhance the accuracy of positioning of the fuel injection valve I in the rotating direction.

The connecting groove 12 and the positioning projection 13 are integrally formed on the outer skin 10 formed from a synthetic resin by molding to cover the outer periphery of the coil of the fuel injection valve I. Therefore, the connecting groove 12 and the positioning projection 13 can be formed along with the outer skin 10, made of the synthetic resin, of the fuel injection valve I, and a post-processing is not required, whereby a reduction in cost can be provided.

Further, the positioning projection 13 is formed so as to be connected to the bottom of the connecting groove 12. Therefore, the root of the positioning projection 13 is thickened and increased in strength, whereby the strength of the fuel injection valve I around the connecting groove 12 can be also increased.

Although the embodiment of the present invention has been described in detail, it will be understood that the present invention is not limited to the above-described embodiment, and various modifications in design may be made without departing from the spirit and scope of the invention defined in claims. For example, the notch-shaped positioning bore 18 in the connecting flange 17 in the fuel supply port 16 may be a circular bore or a recessed bore. In addition, the positioning bore 18 may be formed to be convergent toward the fuel inlet portion 6.

What is claimed is:

1. A structure of mounting a fuel injection valve to a fuel distribution pipe, in which an annular connecting groove (12) is defined in an outer peripheral surface of an intermediate portion of a fuel injection valve (I) which has, at one end thereof, a fuel injection portion (5) inserted in a fuel injection bore (3) in an engine (E) and at the other end thereof, a fuel inlet portion (6) inserted in a fuel supply port (16) in a fuel distribution pipe (D); a connecting flange (17) is formed in said fuel supply port (16) and aligned axially with said connecting groove (12); a collar portion (22) and a locking groove (21) are engaged with said connecting groove (12) and said connecting flange (17), respectively, and are provided in a connecting member (20) for resiliently clamping said fuel injection valve (I) and said fuel supply port (16) from opposite outsides, wherein a positioning bore (18) is provided in said connecting flange (17), and a positioning projection (13) is formed on said fuel injection valve (I) so as to be brought into engagement in said positioning bore (18) simultaneously with the insertion of said fuel inlet portion (6) into said fuel supply port (16).

2. A structure of mounting a fuel injection valve to a fuel distribution pipe according to claim 1, wherein at least one of said positioning projection (13) and said positioning bore (18) is formed to be convergent toward said fuel inlet portion (6).

3. A structure of mounting a fuel injection valve to a fuel distribution pipe according to claim 1 or 2, wherein said connecting groove (12) and said positioning projection (13) are formed integrally in an outer skin (10) formed from a synthetic resin by molding to cover an outer periphery of a coil of said fuel injection valve (I).

4. A structure of mounting a fuel injection valve to a fuel distribution pipe according to any of claims 1 to 2, wherein said positioning projection is provided with a step (13*a*) for abutting against said connecting flange (17) to define a depth of insertion of said fuel injection valve (I) into said fuel supply port (16).

5. A structure of mounting a fuel injection valve to a fuel distribution pipe according to any of claims 1 to 2, wherein said positioning projection (13) is formed so as to be connected to a bottom of said connecting groove (12).

* * * * *